US006310445B1

(12) United States Patent
Kashaninejad

(10) Patent No.: US 6,310,445 B1
(45) Date of Patent: Oct. 30, 2001

(54) LED INDICATOR DISABLE CIRCUIT AND LED INDICATOR INCORPORATING THE LED INDICATOR DISABLE CIRCUIT

(75) Inventor: Hamid Kashaninejad, Ocean, NJ (US)

(73) Assignee: Dialight Corporation, Manasquan, NJ (US)

( * ) Notice: Subject to any disclaimer, the term of this patent is extended or adjusted under 35 U.S.C. 154(b) by 0 days.

(21) Appl. No.: 09/476,140

(22) Filed: Jan. 3, 2000

(51) Int. Cl.[7] ..... G05F 1/00

(52) U.S. Cl. ..... 315/291; 315/307; 315/120; 315/129; 362/800

(58) Field of Search ..... 315/291, 119, 315/129, 136, 185 R, 185 S, 209 R, 224, 225, 240, 297, 307; 362/800, 84, 227

(56) References Cited

U.S. PATENT DOCUMENTS 4,211,955 * 7/1980 Ray ..... 315/53
5,661,645 * 8/1997 Hochstein ..... 363/89
5,770,925 * 6/1998 Konopka et al. ..... 315/225
6,040,663 * 3/2000 Bucks et al. ..... 315/291
6,051,935 * 4/2000 Bucks et al. ..... 315/224
6,057,651 * 5/2000 Usami ..... 315/291

* cited by examiner

*Primary Examiner*—Don Wong
*Assistant Examiner*—Tuyet T. Vo
(74) *Attorney, Agent, or Firm*—Oblon, Spivak, McClelland, Maier & Neustadt, P.C.

(57) ABSTRACT

Circuitry for an LED indicator which can enable and disable the LED indicator at appropriate times. An LED indicator, for example an array of LEDs, is driven by a driving circuit including a control circuit. An input is configured to sense an input line voltage in the LED driving circuit. A further circuit is connected to the input and outputs a first signal or a second signal based on whether the sensed input line voltage is above or below a threshold value. Further, a signal line connects an output of the further circuit to the control circuit of the driving circuit. The control circuit disables driving of the LED indicator based on the further circuit providing an indication whether the sensed input line voltage is above or below the threshold value. The LED indicator may find particular application in an LED traffic signal. With such circuitry in the present invention, a signal which is not intended to illuminate will not in fact illuminate.

21 Claims, 2 Drawing Sheets

LED INDICATOR DISABLE CIRCUIT AND LED INDICATOR INCORPORATING THE LED INDICATOR DISABLE CIRCUIT

BACKGROUND OF THE INVENTION

1. Field of the Invention

The present invention is directed to circuitry utilized in an LED indicator, such as a LED traffic signal, which improves safety of the LED indicator by ensuring that it is on and off at appropriate times.

2. Discussion of the Background

Utilizing light emitting diodes (LEDs) as indicators is common because, among other things, LEDs provide benefits of long life and low power consumption over conventional indicators such as incandescent lamps, fluorescent lamps, etc. Traffic signals utilizing an array of LEDs as an indicator are also known.

Traffic signals are generally powered from controllers located at each traffic intersection. Those controllers have load switches, which are typically solid state relays, that switch power on and off to the traffic signals. For safety reasons the controllers also include conflict monitor circuitry which is utilized to ensure safe operation of the traffic signal, among other things. More particularly, the conflict monitor circuitry seeks to prevent unsafe situations such as a light failing to illuminate or multiple lights illuminating simultaneously. To perform those functions the conflict monitor circuitry must determine for each traffic signal at the intersection which lights are on and which lights are off.

Conflict monitor circuitry senses voltage across a traffic signal light to determine if it is lit or not. This circuitry is typically set to comply with NEMA standards for traffic signal controllers. For red lights, the conflict monitor circuitry treats voltages less than 50 volts as "off", 50–70 volts as "undefined", and greater than 70 volts as "on". Green and yellow lights are treated in similar fashion except at different voltages. They are treated as "on" for voltages of 25 volts or higher, undefined for 15–25 volts, and "off" for voltages less than 15 volts.

In the context of a red traffic light, it is most important that the conflict monitor circuitry accurately determine whether the red light is on. Otherwise, vehicle motorists could mistakenly enter an intersection when cross traffic is authorized, creating an unsafe condition. The conflict monitor circuitry exists to prevent this scenario, switching to a flashing mode when measured voltages imply no light or dual indication.

For the green or yellow lights the same voltage characteristic is measured. However, the most important characteristics for the green and yellow lights is that if the conflict monitor circuitry interprets the green and yellow lights as being off, that the green and yellow lights in fact be off. Otherwise, it is possible that both green and red signals are lit simultaneously, causing confusion and a possible safety hazard.

Even though line voltages for traffic signals are typically 120 VAC, it is possible for traffic signals to experience voltage potentials across them between 25 to 50 VAC, at which point the conflict monitor circuitry may not have a clear indication as to whether certain lights are on or off. Such a situation may also occur with incandescent lamps.

A potentially dangerous situation may arise when traffic signals are connected in a particular configuration which includes a high-impedance connection between an AC input neutral connection of two signals. Such a situation is further explained with reference to FIG. 1.

FIG. 1 shows a situation in which two traffic signals are connected to an input line voltage of 120 VAC and a neutral signal line. Load switches $S_R$, $S_Y$, and $S_G$ for each color light are utilized to turn lights on and off.

In the situation shown in FIG. 1, the red traffic lights $R_1$ and $R_2$ are to be turned on and illuminate when switch $S_R$ is closed. In the instance when these red lights $R_1$ and $R_2$ are to illuminate, current flows through red lights $R_1$ and $R_2$ from the 120 VAC input line voltage to the neutral lines $N_1$ and $N_2$. However, if a high impedance 7 exists between the neutral line $N_1$ from one signal head and its connection with the other neutral line $N_2$, then the current may be diverted in a reverse path through green traffic signal $G_1$ and yellow signal $Y_1$, as shown by the arrows in FIG. 1. The current then flows in a normal direction through the green traffic light $G_2$ and yellow signal $Y_2$ to the output on the neutral line $N_2$ to complete the current flow to the AC line. That is, a situation may arise in which high impedance 7 exists between the two common connections. The high impedance 7 is formed by a fault in the wiring connecting the lights. In such a situation as shown in FIG. 1, the green $G_1$ and $G_2$ and/or yellow $Y_1$, and $Y_2$ lights may appear somewhat illuminated at the same time as the red lights $R_1$ and $R_2$. In that situation, a red light and a green light facing in a same direction may be illuminated simultaneously, causing a dangerous situation as an oncoming motorist will not know whether to proceed or stop at the traffic intersection.

SUMMARY OF THE INVENTION

Accordingly, one object of the present invention is to provide novel circuitry for an LED indicator which overcomes the above-noted and other drawbacks recognized by the present inventor. Such circuitry may find particular application to LED traffic signals.

A further and more specific object of the present invention is to provide novel circuitry for an LED indicator which can ensure that the LED indicator is only turned on at appropriate times.

A further and more specific object of the present invention is to provide a novel LED traffic signal with circuitry to enhance safety features and to ensure that the LED traffic signal operates properly.

The present invention achieves the above and other objects by providing novel circuitry for an LED indicator, such as a LED traffic signal, which can enable and disable the LED indicator at appropriate times. An LED indicator, for example an array of LEDs, is driven by a driving circuit including a control circuit. An input is configured to sense an input line voltage in the LED driving circuit. A further circuit is connected to the input and outputs a first signal or a second signal based on whether the sensed input line voltage is above or below a threshold value. Further, a signal line connects an output of the further circuit to the control circuit of the driving circuit. The control circuit disables driving of the LED indicator based on the further circuit providing an indication whether the sensed input line voltage is above or below the threshold value. With such circuitry in the present invention, a signal which is not intended to illuminate will not in fact illuminate.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 2:
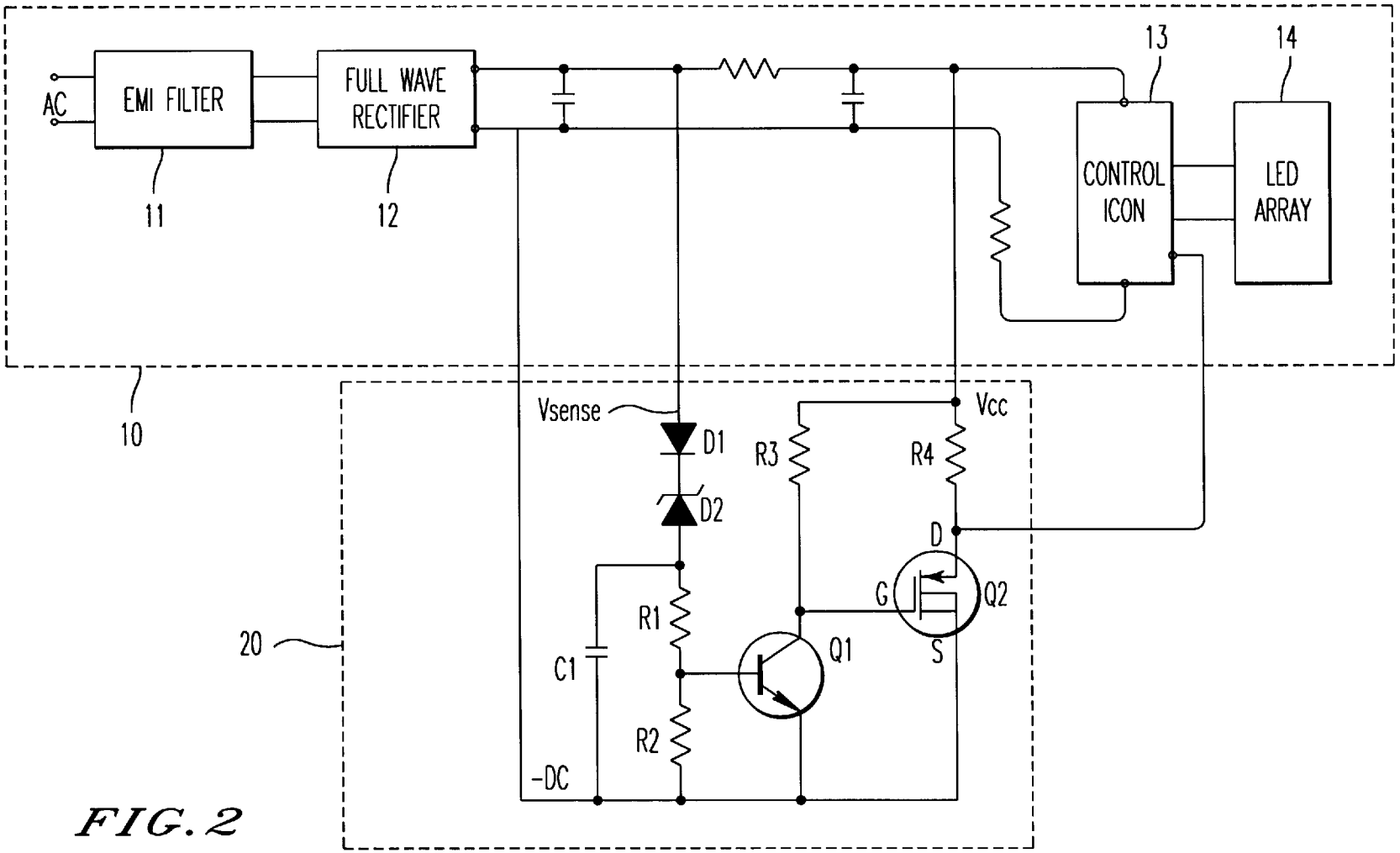
FIG. 2 shows the novel circuitry of the present invention.

Referring now to FIG. 2, a schematic diagram of circuitry of the present invention is shown in further detail.

FIG. 2 shows an input portion 10 of a conventional LED indicator, which as noted above may typically be an LED traffic signal. The LED traffic signal input portion 10 includes an EMI filter 11 connected to AC input lines. An output of the EMI filter is provided to a full wave rectifier 12. An output of the full wave rectifier 12 is connected to a control IC 13. The control IC 13 in turn is connected to an LED array 14 and the control IC 13 controls the driving of the LED array 14. The LED array 14 may be any type of array of LEDs connected in series, in parallel, etc., and could in the simplest form be a single LED. It is most conventional in LED traffic signals for the LED array 14 to include several strings of series connected LEDs, each string connected in parallel.

The novel feature of the present invention is to include additional circuitry 20 which ensures that the LED array 14 is enabled and disabled from illuminating at the appropriate times.

The circuit 20 senses a line input voltage, e.g. the voltage output from the full wave rectifier 12, and provides a signal to the control IC 13 indicating the sensed line input voltage. The control IC 13 in turn then either enables or disables the LED array 14 based on the signal provided from the circuit 20.

In the embodiment shown in FIG. 2 the input line voltage sensed by the circuit 20 is an output of the full wave rectifier 12, although the point at which the circuit 20 senses the input line voltage may be other appropriate points of the LED traffic signal 10.

In the embodiment shown in FIG. 2, the Vsense input is derived by connecting the output of the full wave rectifier 12 to a series-connected diode D1 and a zener diode Z1, together with establishing the line voltage trip point. Connected to the zener diode Z1, through a resistor R1, is a base of a transistor Q1. Also connected to the resistor R1 is a resistor R2 in series therewith, and a capacitor C1 in parallel with resistors R1 and R2. The resistors R1 and R2 operate as a voltage divider to adjust the base drive of transistor Q1. The value of zener diode Z1 is selected to establish an appropriate trip point to turn transistor Q1 on and off. When the input line voltage is at 120 VAC the value of resistors R1 and R2 may be 220 KΩ, as an example. Capacitor C1 may also be, as an example, a 0.1 $\mu$F capacitor.

With such a structure in the present invention, when the voltage developed at the point between resistors R1 and R2, i.e. at the base of transistor Q1, exceeds a predetermined threshold level, i.e., the established trip point, the transistor Q1 turns on.

An output of transistor Q1 is connected to the gate of FET transistor Q2. Connected to the drain of the FET Q2 is a resistor R4. A resistor R3 is connected in parallel with the resistor R4. Resistors R3 and R4 operate as a pull up circuit for transistors Q1 and Q2. Resistors R3 and R4 may also have values of 220 KO, in the example noted above.

With such a structure in the circuit 20 of FIG. 2, when the FET Q2 is on, the drain of the FET Q2 is pulled to a logical "low" value. The control IC 13 recognizes the logical low value and based on such disables the LED array 14 from illuminating. Conversely, when the FET Q2 is off, a logical "high" value signal is supplied to the control IC 13, which based on such enables the LED array 14 to illuminate.

The circuit 20 of FIG. 2 operates as follows. When the sensed input line voltage is above the threshold trip value, the current to the base of transistor Q1 exceeds a certain value, and the transistor Q1 thereby turns on. That results in turning FET Q2 off, resulting in a logical high voltage being provided to the control IC 13. When the control IC 13 sees that logical high voltage, it enables power to the LED array 14. With this method, the LED array 14 can be powered to illuminate only if the input line voltage exceeds a certain threshold.

When the sensed input line voltage is below the threshold trip point, the transistor Q1 turns off, turning FET Q2 on. At that instance the control IC 13 receives a logical low value signal from the FET Q2. When the control IC 13 see the logical low value signal it disables the LED array 14 from illuminating. Thus, the LED array 14 does not illuminate if the input line voltage is below a certain threshold.

Figure 1:
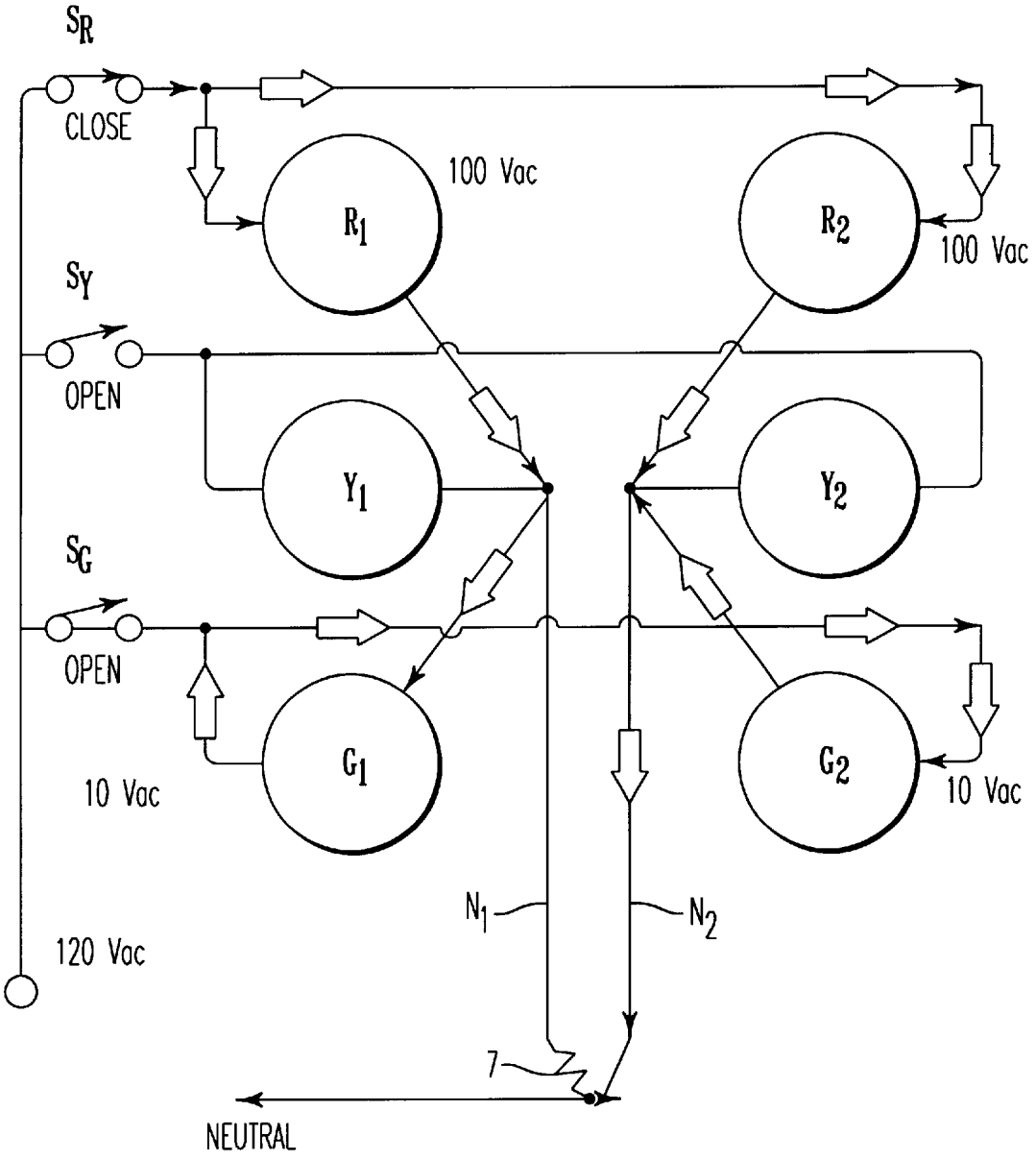
FIG. 1 shows a situation arising in background art which can be overcome by the present invention.

The circuitry of the present invention shown in FIG. 2 can avoid the improper situation shown in FIG. 1 in which both red and green lights are on at the same time. More particularly, assume that the circuitry 20 of the present invention of FIG. 2 is connected to each of the green lights 1 and 2 in FIG. 1, although the circuitry 20 may be connected to any number of traffic signals. In the situation in FIG. 1 in which the red lights 3 and 4 are to illuminate, the input line voltages to the green lights 1 and 2 will be well below a threshold value, as a result of the switch 5 being opened. Since the input line voltages to green lights 3 and 4 are below the threshold value, a control IC connected to each of the green lights 1 and 2 sees a logical low value from their respective circuits 20, which, in turn, disables the LED arrays in the green lights 1 and 2. As a result, the green lights 1 and 2 will not illuminate. Thereby, the improper current flowing through green lights 1 and 2 in such a situation does not result in green lights 1 and 2 illuminating.

The threshold value can be established at different points, although one beneficial value for setting the threshold may be 40 VAC. Such a voltage meets the criteria of assuring that for the voltage levels interpreted by the conflict monitor indicating that the red light is on (i.e. 50 VAC or higher), the red light will actually be on. Similarly, the voltage levels interpreted by the conflict monitor for the green or yellow lights being off (i.e. 25 volts or lower), will indicate that those lights are actually off.

Obviously, numerous modifications and variations of the present invention are possible in light of the above teachings. It is therefore to be understood that within the scope of the appended claims, the present invention may be practiced otherwise than as specifically described herein.

What is claimed is:

1. An LED indicator disable circuit connected to an LED driving circuit, the LED driving circuit including a control circuit controlling LED indicator by enabling driving of the LED indicator when receiving a first logical signal and disabling driving of the LED indicator when receiving a second logical signal, comprising:

(a) an input configured to sense an input line voltage in the LED driving circuit;

(b) a circuit connected to said input and configured to output the first logical signal when the sensed input line voltage is above a threshold value and to output the second logical signal, opposite to the first logical signal, when the sensed input line voltage is below the threshold value; and (c) a signal line configured to connect an output of said circuit to the control circuit, the control circuit disabling driving of the LED indicator when the output of said circuit is the second logical signal.

2. An LED indicator disable circuit according to claim 1, wherein the LED indicator is a traffic signal.

3. An LED indicator disable circuit according to claim 1, wherein said circuit (b) comprises:

(b1) a first transistor connected to said input to turn on when the sensed input line voltage is above the threshold value and to turn off when the sensed input line voltage is below the threshold value.

4. An LED indicator disable circuit according to claim 3, wherein said circuit (b) further comprises:

(b2) a second transistor to turn on when said first transistor is off and to turn off when said first transistor is on, an output of said second transistor being connected to said signal line.

5. An LED indicator disable circuit according to claim 4, wherein said second transistor is a field effect transistor.

6. An LED indicator disable circuit according to claim 1, wherein said input (a) comprises:

(a1) a diode connected to a line on which the input line voltage is developed; and (a2) a zener diode connected between said diode and said circuit.

7. An LED indicator disable circuit according to claim 6, wherein said circuit (b) comprises:

(b1) a first transistor connected to said input to turn on when the sensed input line voltage is above the threshold value and to turn off when the sensed input line voltage is below the threshold value.

8. An LED indicator disable circuit according to claim 7, wherein said circuit (b) further comprises:

(b2) a second transistor to turn on when said first transistor is off and to turn off when said first transistor is on, an output of said second transistor being connected to said signal line.

9. An LED indicator disable circuit according to claim 8, wherein said second transistor is a field effect transistor.

10. An LED indicator for providing an indication on at least one LED, comprising:

(a) a driving circuit configured to drive said at least one LED based on an input line voltage, and including (al) a control circuit configured to control driving of the at least one LED by enabling driving of said at least one LED when receiving a first logical signal and disabling driving of said at least one LED when receiving a second logical signal;

(b) an input configured to sense the input line voltage;

(c) a circuit connected to said input and configured to output the first logical signal when the sensed input line voltage is above a threshold value and to output the second logical signal, opposite to the first logical signal, when the sensed input line voltage is below the threshold value; and (d) a signal line configured to connect an output of said circuit to said control circuit, said control circuit disabling driving of said at least one LED when the output of said circuit is the second logical signal.

11. An LED indicator according to claim 10, wherein said LED indicator is a traffic signal.

12. An LED indicator according to claim 10, wherein said driving circuit (a) further comprises (a2) a full wave rectifier outputting the input line voltage.

13. An LED indicator according to claim 10, wherein said circuit (c) comprises:

(c1) a first transistor connected to said input to turn on when the sensed input line voltage is above the threshold value and to turn off when the sensed input line voltage is below the threshold value.

14. An LED indicator according to claim 13, wherein said circuit (c) further comprises:

(c2) a second transistor to turn on when said first transistor is off and to turn off when said first transistor is on, an output of said second transistor being connected to said signal line.

15. An LED indicator according to claim 14, wherein said second transistor is a field effect transistor.

16. An LED indicator according to claim 10, wherein said input (b) comprises:

(b1) a diode connected to a line on which the input line voltage is developed; and (b2) a zener diode connected between said diode and said circuit.

17. An LED indicator according to claim 16, wherein said circuit (c) comprises:

(c1) a first transistor connected to said input to turn on when the sensed input line voltage is above the threshold value and to turn off when the sensed input line voltage is below the threshold value.

18. An LED indicator according to claim 17, wherein said circuit (c) further comprises:

(c2) a second transistor to turn on when said first transistor is off and to turn off when said first transistor is on, at output of said second transistor being connected to said signal line.

19. An LED indicator according to claim 18, wherein said second transistor is a field effect transistor.

20. An LED indicator disable circuit connected to an LED driving circuit including a control circuit controlling driving of an LED indicator by enabling driving of the LED indicator when receiving a first logical signal and disabling driving of the LED indicator when receiving a second logical signal, comprising:

(a) input means for sensing an input line voltage in the LED driving circuit;

(b) circuit means for outputting the first logical signal when the sensed input line voltage is above a threshold value and to output the second logical signal, opposite to the first logical signal, when the sensed input line voltage is below the threshold value; and (c) means for supplying an output of said circuit means to the control circuit, the control circuit disabling driving of the LED indicator when an output of said circuit means is the second logical signal.

21. An LED indicator for providing an indication on LED indicator means, comprising:

(a) driving means for driving said LED indicator means by enabling driving of the LED indicator means when receiving a first logical signal and disabling driving of the LED indicator means when receiving a second logical signal;

(b) input means for sensing an input line voltage in sail driving means;

(c) circuit means for outputting the first logical signal when the sensed input line voltage is above a threshold value for outputting the second logical signal, opposite to the first logical signal, when the sensed input line voltage is below the threshold value; and (d) means for supplying an output of said circuit means to said driving means, said driving means disabling driving of said LED indicator means when an output of said circuit means is the second logical signal.

* * * * *